US007441869B2

(12) United States Patent
Powers

(10) Patent No.: US 7,441,869 B2
(45) **Date of Patent: *Oct. 28, 2008**

(54) INK JET PRINT HEAD ADAPTED TO MINIMIZE ORIENTATION-INDUCED LINE-WIDTH VARIATION

(75) Inventor: James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 373 days.

This patent is subject to a terminal disclaimer.

(21) Appl. No.: 11/323,433

(22) Filed: Dec. 30, 2005

(65) Prior Publication Data

US 2007/0153055 A1 Jul. 5, 2007

(51) Int. Cl.
*B41J 2/16* (2006.01)

(52) U.S. Cl. ..... 347/47

(58) Field of Classification Search ..... 347/45, 347/47

See application file for complete search history.

(56) References Cited

U.S. PATENT DOCUMENTS 6,010,208 A * 1/2000 Powers et al. ..... 347/65
6,045,214 A * 4/2000 Murthy et al. ..... 347/47
2004/0052569 A1 3/2004 Bich et al.

* cited by examiner

*Primary Examiner*—An H Do
(74) *Attorney, Agent, or Firm*—Dinsmore & Shobi, LLP

(57) ABSTRACT

Ink jet print head adapted to minimize orientation-induced line-width variation. The print head having n nozzles located at the vertices of a regular or quasi-regular polygon having an average side length $s_{avg}$, and each side length of the polygon is less than 20% deviation from the average side length $s_{avg}$. The n nozzles are configured to ink jet a line having a line-width w; and each of the n nozzles is configured to ink jet a spot having an average area-equivalent spot diameter d which satisfies the inequality condition (I)

$$0.7w \leqq d+(n/\pi)s_{avg} \leqq 1.3w. \quad \text{(I)}$$

16 Claims, 4 Drawing Sheets

INK JET PRINT HEAD ADAPTED TO MINIMIZE ORIENTATION-INDUCED LINE-WIDTH VARIATION

CROSS-REFERENCE TO CO-PENDING APPLICATION

Various methods, systems and apparatus relating to the present invention are disclosed in a co-pending U.S. Patent Application that is filed contemporaneously with this application, on Dec. 30, 2005, by the same inventor and assignee. The co-pending patent application bears the title "INK JET PRINT HEAD ADAPTED TO MINIMIZE ORIENTATION-INDUCED LINE-WIDTH VARIATION" and the contents of that co-pending patent application are hereby incorporated by reference.

TECHNICAL FIELD

The present invention relates to a hand-held ink jet printer, and more specifically to a unique heater/nozzle configuration on a print head for an orientation-tolerant ink jet printer.

BACKGROUND OF THE INVENTION

The conventional writing pen is well-known in the art. One of the primary characteristics of the established design of a writing pen is that the pen tip is visible to the user. This allows the user to visually connect his writings to each other. Recently, ink jet print technology has been incorporated into a pen to form a hand-held ink jet pen. Ink jet printing is a conventional technique by which printing is accomplished without contact between the print head and a substrate or medium, on which the desired print characters are deposited. Such printing is accomplished by ejecting ink from the ink jet print head of the ink jet pen via numerous methods which employ, for example, pressurized nozzles, electrostatic fields, piezo-electric elements and/or heaters for vapor-phase droplet formation. Some of the hand-held ink jet pens of the prior art have employed a measurement means for measuring, without physical contact, the distance between the print head and the substrate. The measurement means is typically connected to a processor unit which is adapted to cause the ink jet system to be activated when the measurement means determines the distance between the ink jet print head and the substrate is less than a predetermined maximum value and simultaneously a movement detector detects movement of the ink jet pen. However, such sensors require additional space that can depart from the conventional pen shape that a user has been so comfortable with over the years. As such, space is limited and places a constraint on the number of electrical sensors and connections that can be placed inside the physical constraints of the ink jet pen.

In the case of a traditional writing pen, line-width is a primary descriptor by which the customer makes his choice. Line-width is typically specified either directly in millimeters or by such adjectives as "bold", "medium", "fine", or "extra-fine", each with a specified meaning within the industry. Line-widths of 0.200, 0.300 and 0.500 millimeters are industry standards; although such descriptions apply directly only for a particular ink and paper combination and a particular pen tip speed. As such, when designing a print head, some of the technical challenges include determining the optimum number of heaters and nozzles, optimal spacial configurations and corresponding optimal spot size so as to achieve a specified line-width with a minimum of variation.

Line-width variation can come from multiple sources. These sources include: 1) variations in surface and absorption properties of the print media (these typically occur in media from different sources or even from a single unit from a particular source); 2) variations in environment, particularly in temperature and humidity (these cause variations in the moisture content of the print medium and thereby to variations in ink absorptive properties); 3) variations in drop mass and jet velocity caused by variations in reservoir back pressure, heater conditions, etc.; and 4) variation in the user's manner of holding and moving the pen.

The first three sources are well-known to those skilled in the art of traditional ink jet technology. The fourth listed source of variation (the user manner of holding and moving the pen) is unique to the hand-held ink jet writing pen. As such, there is a need for a hand-held ink jet pen having a print head configured to minimize variations in line-width due to orientation of the ink jet pen. Accordingly, improved ink jet printers are desired.

SUMMARY OF THE INVENTION

The present invention relates to an ink jet printer having a print head that has a nozzle configuration adapted to minimize orientation-induced line-width errors. Some embodiments described herein are described in reference to an ink jet print head for an ink jet pen. An ink jet print head comprises n nozzles, wherein the n nozzles are located at vertices of a polygon having an average side length $s_{avg}$. Each side length of the polygon is less than 20% deviation from the average side length $s_{avg}$. The n nozzles are configured to ink jet a line having a line-width w. Each of the n nozzles is configured to ink jet a spot having an average area-equivalent spot diameter d which satisfies the inequality condition (I)

$$0.7w \leqq d+(n/\pi)s_{avg} \leqq 1.3w \quad \text{(I).}$$

Another described embodiment is an ink jet print head adapted to minimize orientation-induced line-width variation. The ink jet print head comprises n nozzles, wherein the n nozzles are configured to ink jet a line having a line-width w. The n nozzles are located at vertices of a polygon having an average side length $s_{avg}$. Each side length of the polygon is less than 20% deviation from the average side length $s_{avg}$ which satisfies the inequality conditions (IIa, IIb) with the coefficient $\lambda=1.3$ $$w \sin(\pi/n)/[\lambda+(n/\pi)\sin(\pi/n)] \leqq s_{avg} \leqq w/[1+n/\pi], \text{ where } n=2, 3, 4 \quad \text{(IIa), and}$$

$$w \sin(\pi/n)/[\lambda+(n/\pi)\sin(\pi/n)] \leqq s_{avg} \leqq w \tan(\pi/n)/[1+(n/\pi)\tan(\pi/n)], \text{ where } n=5, 6, 7, \quad \text{(IIb).}$$

Yet another described embodiment is an ink jet print head adapted to minimize orientation-induced line-width variation. The ink jet print head comprises n nozzles, wherein the n nozzles are configured to ink jet a line having a line-width w. The n nozzles are configured to ink jet a polygonal array of ink spots having an average area-equivalent spot diameter d which satisfy the inequality conditions (IVa, IVb) with the coefficient $\lambda=1.3$ $$w/[1+n/\pi] \leqq d \leqq \lambda w/[\lambda+(n/\pi)\sin(\pi/n)], \text{ where } n=2, 3, 4 \quad \text{(IVa), and}$$

$$w/[1+(n/\pi)\tan(\pi/n)] \leqq d \leqq \lambda w/[\lambda+(n/\pi)\sin(\pi/n)], \text{ where } n=5, 6, 7, \quad \text{(IVb).}$$

Another aspect of the present invention is an ink jet print head adapted to minimize orientation-induced line-width variation. The ink jet print head comprises n nozzles, wherein the n nozzles are located at vertices of a polygon having an average side length $s_{avg}$. Each side length of the polygon is less than 20% deviation from the average side length $s_{avg}$. Each of the n nozzles is configured to ink jet a spot having an average area-equivalent spot diameter d which satisfies the inequality conditions (VIIa, VIIb) with the coefficient $\lambda=1.3$ $$s_{avg} \leqq d \leqq \lambda s_{avg} \csc(\pi/n), \text{ where } n=2, 3, 4 \quad \text{(VIIa), and}$$

$$s_{avg} \cot(\pi/n) \leqq d \leqq \lambda s_{avg} \csc(\pi/n), \text{ where } n=5, 6, 7, \quad \text{(VIIb).}$$

Yet another described embodiment is an ink jet print head adapted to minimize orientation-induced line-width variation. The ink jet print head comprises n nozzles, wherein the n nozzles are located at vertices of a polygon for the purpose of ink jetting a polygonal array of ink spots having an average area-equivalent spot diameter d. Each of the side lengths s of the polygon satisfies the inequality conditions (VIIIa, VIIIb) with the coefficient $\lambda=1.3$ $$d \sin(\pi/n)/\lambda \leqq s \leqq d, \text{ where } n=2, 3, 4 \quad \text{(VIIIa), and}$$

$$d \sin(\pi/n)/\lambda \leqq s \leqq d \tan(\pi/n), \text{ where } n=5, 6, 7, \quad \text{(VIIIb).}$$

The ink jet print heads of the present invention are advantageous for providing an ink jet printer having minimized orientation-induced line-width variations. These and additional advantages will be apparent in view of the detailed description.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

Figure 1:
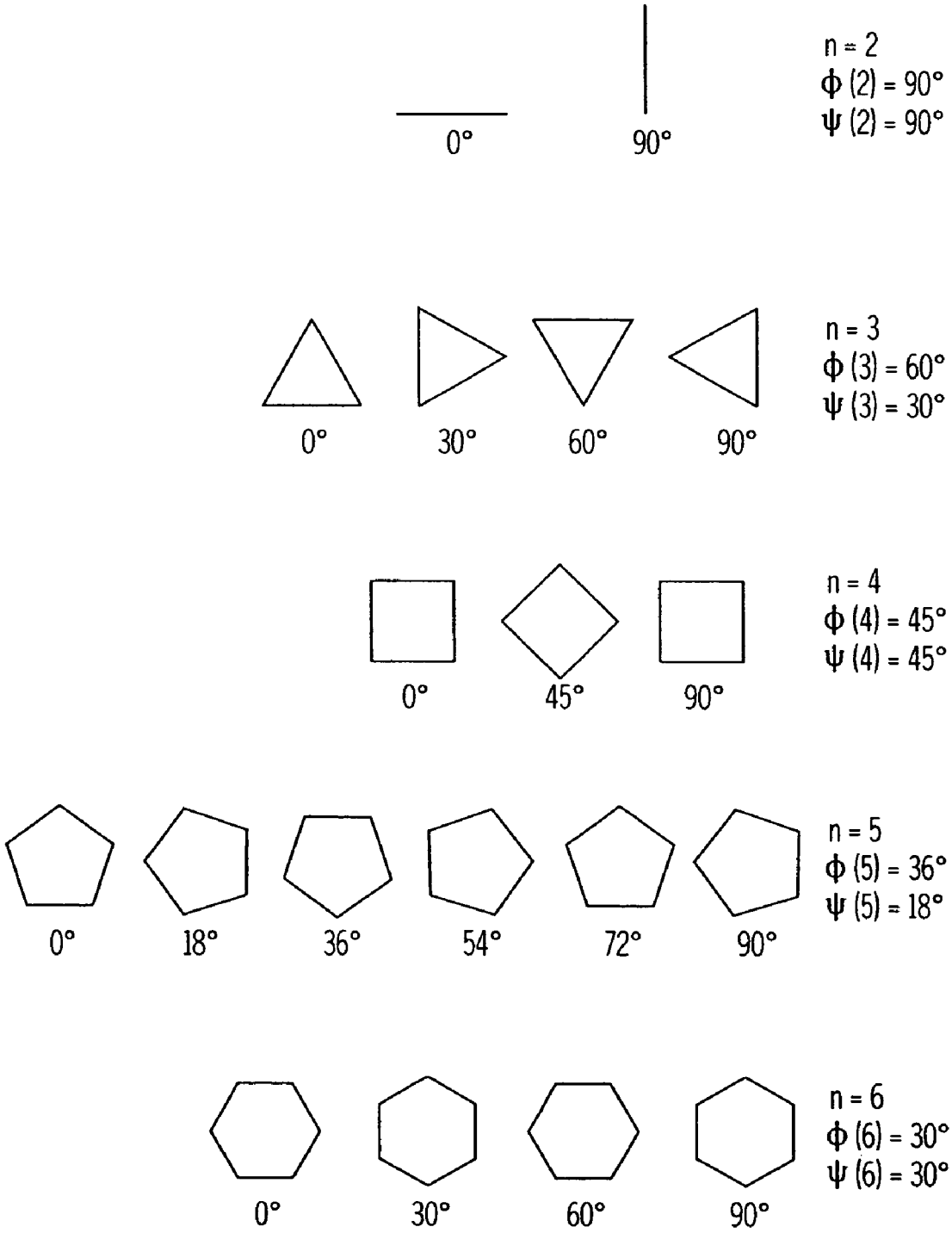
FIG. 1 is a schematic illustration of a rotation of regular polygons according to a first embodiment of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE EXEMPLARY EMBODIMENTS OF THE INVENTION

In one exemplary embodiment of the present invention, an ink jet print head is adapted to minimize orientation-induced line-width variations in a hand-held ink jet pen. For ease of explanation, much of the following description is written in the context of describing improvements to an ink jet pen. But one of ordinary skill in the art will readily recognize that the print head improvements described herein are equally advantageous when used with other types of ink jet printers that are manually moved across a print surface during a print operation.

In the context of an ink jet pen, an orientation of the printer with respect to paper and line-scan direction can be specified by two angles:

The angle $\tau$ describes the tilt angle between a perpendicular to the plane of the paper and the pen barrel.

The angle $\theta$ describes the rotational angle between the line-scan direction and a principle axis of the nozzle array.

The rotational orientation of the nozzle array with respect to the line-scan direction is particularly important. To better understand this point, imagine a hand-held pen with two nozzles. If the nozzles are initially perpendicular to the line-scan direction, then, neglecting surface tension effects, a ninety-degree rotation of the pen barrel causes a difference in line-width on the order of the nozzle spacing.

One exemplary embodiment of the present invention comprises an ink jet pen having heaters and nozzles placed at the vertices of regular polygons. One main reason for contemplating regular polygons rises from classical geometry: among all general polygons with a fixed number of vertices, those with the least difference between minimum and maximum widths are the regular ones.

In an alternative embodiment of the present invention, heaters and nozzles are placed at the vertices of quasi-regular polygons. By quasi-regular polygon it is meant that each side length of the polygon deviates less than 30% from the average side length.

Conceptually, the most elegant solution would appear to be a single nozzle. The enabling structures (heaters, flow features, nozzle, ink vias, etc.) occupy the least space on the heater chip and line-width has no rotational dependence whatever. However, unless the desired line-width is quite thin, the single-nozzle solution may encounter considerable difficulties due to the size of the required ink drop.

One is therefore led to consider two-nozzle configurations. These suffer from the particularly severe rotational dependence described above; nevertheless, given a target line-width, it is reasonable to seek an optimal relationship between nozzle spacing and spot size—one for which the variation in line-width is minimized.

Similar considerations apply to nozzles arrayed at the vertices of an equilateral triangle, a square, or any regular polygon.

Nozzle Arrangement: Mathematical Framework

Glossary of Terms and Symbols:

w . . . prescribed target line-width n . . . number of nozzles, located at the vertices of a regular or quasi-regular polygon, $\phi(n)$ . . . polar half-angle; i.e., half the angle subtended by adjacent nozzles $\psi(n)$ . . . polar symmetry half-angle, defined below d . . . printed spot diameter—diameter of an area-equivalent circle R . . . radius of the circle circumscribing the regular polygon $\tau$ . . . tilt angle between the pen barrel and a perpendicular to the plane of the print medium $\theta$ . . . plane rotational angle, with reference to the pen tip scan direction s . . . side length of the regular or quasi-regular polygon t . . . radius of the circle inscribed in the regular polygon $h(\theta)=h(\theta; R, n)$ . . . width of the polygon with respect to pen tip scan direction, expressed as a function of the rotation angle h*(R, n . . . mean polygon width, further described below v . . . variance of the probability distribution associated with polygon width under rotation λ . . . maximum spot diameter oversize ratio; that is, the maximum recommended value of the ratio d/2R Standard notations for trigonometric functions are employed: for an arbitrary angle θ, sin θ, cos θ, tan θ, csc θ, sec θ and cot θ denote the sine, cosine, tangent, cosecant, secant, and cotangent functions of the angle θ.

While not being limited to a theory, it is believed that given a line-width w, a nozzle count n and a pen tilt angle τ, variations in line-width due to pen rotation are minimized by placing nozzles at the vertices of a regular polygon with side length s, taken from the range:

$$w\sec(\tau)\sin(\pi/n)/[\lambda+(n/\pi)\sin(\pi/n)]\leqq s\leqq w\sec(\tau)/[1+n/\pi],\ n=2,3,4$$

$$w\sec(\tau)\sin(\pi/n)/[\lambda+(n/\pi)\sin(\pi/n)]\leqq s\leqq w\sec(\tau)\tan(\pi/n)/[1+(n/\pi)\tan(\pi/n)],\ n=5,6,7,$$

The coefficient λ here has been experimentally determined for various ink and print medium combinations. Line quality has been determined to be acceptable if λ does not exceed a value of about 1.3.

Given a polygonal nozzle configuration as specified by the polygon side length s, the ideal area-equivalent spot diameter is given by the formula $$d=w-(n/\pi)s;$$

but any spot diameter in the following ranges (depending on the appropriate value of n) satisfies the essential area coverage requirement:

$$s\leqq d\leqq\lambda s\csc(\pi/n),\ n=2,3,4$$

$$s\cot(\pi/n)\leqq d\leqq\lambda s\csc(\pi/n),\ n=5,6,7,$$

Since spot diameter is difficult to constrain within a narrow range, the following broader range continues to meet the essential spatial requirements for selected special cases:

$$s\leqq d\leqq 2s,\ n=2,3,4,5.$$

First Consideration: Minimization of Rotation-induced Line-width Variation

A nozzle configuration derived from the formula d=w−(n/π)s minimizes a function F(m), defined as the following integral of 'least-squares' type:

$$F(m)=\int_{-\pi}^{+\pi}[h(\theta)-m]^2d\theta.$$

A few preliminary definitions are required for the significance of the function F(m) to become apparent. First, the polar symmetry half-angle ψ(n) and the coefficient function β(n) are defined:

$$\psi(n)=\begin{cases}\pi/n & \text{for } n=2,4,6,8,\ldots\\ \pi/2n & \text{for } n=3,5,7,9,\ldots\end{cases}$$

$$\beta(n)=\begin{cases}1 & \text{for } n=2,4,6,8,\ldots\\ \cos(\pi/2n) & \text{for } n=3,5,7,9,\ldots\end{cases}$$

The polygon width function h(θ) can be defined on the interval −ψ(n)≦θ≦ψ(n) and then extended as an even periodic function of θ:

$$h(\theta)=h(\theta;R,n)=2R\beta(n)\cos\theta.$$

The independent variable m can be seen to describe a least-squares mean height of the polygon under plane rotations. Analysis of the function F(m) reveals that it achieves a minimum when m=h*(R, n), where h*(R, n) is the mean value of the polygon width function. It can be computed directly from its definition:

$$h*(R,n)=(1/2\pi)\times\int_{-\pi}^{+\pi}h(\theta)d\theta=2R(n/\pi)\sin(\pi/n).$$

In an alternative embodiment, there is an entirely independent route to this important result—based on probability considerations. If one assumes that the angular orientation of a regular polygon is uniformly distributed over the interval −π≦θ≦+π, then the cumulative probability distribution for the polygon height can be determined.

If x=h(θ)/2R β(n), then H: [λ(n), 1]→[0, 1] can be defined as follows, where λ(n)=cos(ψ(n)):

$$H(x)=\arccos(x)/\psi(n).$$

As expected, this distribution's mean is given by h*(R, n). Its variance v can also be computed; and turns out to be given by the revealing expression $$v=F(h*(R,n))/\psi(n).$$

The following relationships between the side length s of a regular polygon, the radius R of its circumscribing circle and the radius t of its inscribing circle are well-known:

$$s=2R\sin(\pi/n),$$

$$t=R\cos(\pi/n).$$

The first of these can be used to cast the above expression of h*(R, n) in terms of the polygon side length s:

$$s=(\pi/n)h*(R,n).$$

Second Consideration: Relationship Between Polygon Side-length and Spot Diameter Given a nozzle spacing s derived from the above formula, another function G(d) of spot diameter d can be defined as an integral of 'least-squares' type and directly related to rotationally induced line-width variation:

$$G(d)=\int_{-\pi}^{+\pi}[h(\theta)+d-w]^2d\theta,$$

where h(θ) is the polygon width function defined above.

Analysis of the function G(d) reveals that it achieves a minimum when d=w−h*(R, n). This constitutes a relationship between spot diameter d and nozzle spacing s—through the intermediary the radius R of the circumscribing circle. This relationship can be stated in any of the following equivalent forms:

$$d+h*(R,n)=w,$$

$$\text{or } d+2R(n/\pi)\sin(\pi/n)=w,$$

or $d+(n/\pi)s=w$, or $d+2t(n/\pi)\tan(\pi/n)=w$.

Satisfaction of this relationship (in any of these forms) by a pair {R, d}, or by an equivalent pair {s, d}, minimizes the line-width variation due to pen rotation.

Third Consideration: An Optimal Range for Area-equivalent Spot Diameter

In an exemplary embodiment, an optimal range for area-equivalent spot diameter is determined. A few sketches of the low nozzle count cases suggest the following observations—which can be confirmed and extended by rigorous analysis:

If d<s then the line may suffer extended interior void streaks due to inadequate spot coverage.

If for given n the spot diameter d falls within the following range:

$$s \leqq d \leqq 2R \text{ for } n=2, 3, 4$$

$$2t \leqq d \leqq 2R \text{ for } n=5, 6, 7,$$

isolated voids may appear in the line interior; but these are unlikely in practice because of the influence of surface tension on the wet ink puddle. These ranges represent the optimal target ranges for area-equivalent spot diameters. (Note that s=2t for n=4).

d=2R represents a kind of geometrical optimum relationship between spot diameter and the radius of the circumscribing circle; in practice, it becomes more of a soft upper bound.

The case where d>2R can be characterized by introducing an experimentally determined coefficient λ, called the maximum spot diameter oversize ratio. It is the maximum value of the ratio d/2R that results in an ink-jetted line of acceptable quality. For most combinations of ink and print media, its value does not exceed 1.3.

If 2R<d≦2λR then spot overlap is moderately excessive. Spot diameters in this range may lead to a reduction of line edge crispness; but overall line quality remains acceptable.

If d>2λR then spot overlap is excessive and leads to an unacceptable reduction in line quality.

Given a desired line-width w, the optimal range of polygon side-length s is established by alternately setting d≧s and d≦2λR in the above relationship. The optimal range for s can thereby be described as:

$$w \sin(\pi/n)/[\lambda+(\pi/n)\sin(\pi/n)] \leqq s \leqq w/[1+n/\pi], \; n=2, 3, 4$$

$$w \sin(\pi/n)/[\lambda+(\pi/n)\sin(\pi/n)] \leqq s \leqq w \tan(\pi/n)/[1+(n/\pi)\tan(\pi/n)], \; n=5, 6, 7,$$

Addition of the coefficient sec τ to account for the effect of a non-zero barrel tilt angle τ can be easily justified and its presence enhances the generality of the formulae. For a fixed side-length s associated with a regular polygonal nozzle configuration, the following area-equivalent spot diameter conforms exactly to the 'Second Consideration' rule stated above:

$$d=w-(n/\pi)s;$$

However, any spot diameter in the following range satisfies the essential area-coverage requirement:

$$s \leqq d \leqq \lambda s \csc(\pi/n), \; n=2, 3, 4$$

$$s \cot(\pi/n) \leqq d \leqq \lambda s \csc(\pi/n), \; n=5, 6, 7,$$

Relaxing the restriction on excessive spot overlap leads to a somewhat broader range for the cases n =2, 3, 4, 5, 6:

$$s \leqq d \leqq 2s.$$

The entire argument above can be prosecuted in reverse. Given an area-equivalent spot diameter d, the ideal range of spot diameters for printing a line of width w is given by $$w/[1+n/\pi] \leqq d \leqq \lambda w/[\lambda+(n/\pi)\sin(\pi/n)], \; n=2, 3, 4$$

$$w/[1+(n/\pi)\tan(\pi/n)] \leqq d \leqq \lambda w/[\lambda+(n/\pi)\sin(\pi/n)], \; n=5, 6, 7,$$

For a fixed area-equivalent spot diameter d, the ideal polygon side-length is given by:

$$s=(\pi/n)[w-d];$$

However, any polygon side length in the following range satisfies the essential area-coverage requirement:

$$d \sin(\pi/n)/\lambda \leqq s \leqq d, \; n=2, 3, 4$$

$$d \sin(\pi/n)/\lambda \leqq s \leqq d \tan(\pi/n), \; n=5, 6, 7,$$

One exemplary embodiment of the present invention comprises an ink jet print head adapted to minimize orientation-induced line-width variation. The print head comprises n nozzles, wherein the n nozzles are located at vertices of a polygon having an average side length $s_{avg}$, and wherein each side length of the polygon is less than 20% deviation from the average side length $s_{avg}$. The n nozzles are configured to ink jet a line having a line-width w; and wherein each of the n nozzles is configured to ink jet a spot having an average area-equivalent spot diameter d which satisfies the inequality condition (I)

$$0.7w \leqq d+(n/\pi)s_{avg} \leqq 1.3w \quad \text{(I)}.$$

Another exemplary embodiment of the present invention comprises an ink jet print head adapted to minimize orientation-induced line-width variation. The print head comprises: n nozzles, wherein the n nozzles are configured to ink jet a line having a line-width w; and wherein the n nozzles are located at vertices of a polygon having an average side length $s_{avg}$ Each side length of the polygon is less than 20% deviation from the average side length $s_{avg}$ which satisfy the inequality conditions (IIa, IIb) with the coefficient λ=1.3

$$w \sin(\pi/n)/[\lambda+(n/\pi)\sin(\pi/n)] \leqq s_{avg} \leqq w/[1+n/\pi], \; n=2, 3, 4 \quad \text{(IIa)},$$

$$w \sin(\pi/n)/[\lambda+(n/\pi)\sin(\pi/n)] \leqq s_{avg} \leqq w \tan(\pi/n)/[1+(n/\pi)\tan(\pi/n)], \; n=5, 6, 7, \quad \text{(IIb)}.$$

In one exemplary embodiment, the polygon is a regular polygon. In an alternative embodiment, the polygon is a quasi-regular polygon. By quasi-regular polygon, it is meant that each side length of the polygon deviates less than 30% from the average side length. In another exemplary embodiment, the n nozzles are configured to ink jet an array of ink spots with each ink spot having an average area-equivalent spot diameter d which satisfies the inequality conditions (IIIa, IIIb) with the coefficient λ=1.3

$$s_{avg} \leqq d \leqq \lambda s_{avg} \csc(\pi/n), \; n=2, 3, 4 \quad \text{(IIa)},$$

$$s_{avg} \cot(\pi/n) \leqq d \leqq \lambda s_{avg} \csc(\pi/n), \; n=5, 6, 7, \quad \text{(IIIb)}.$$

Yet another embodiment of the present invention is an ink jet print head adapted to minimize orientation-induced line-width variation. The print head comprises: n nozzles, wherein the n nozzles are configured to ink jet a line having a line-width w; and wherein the n nozzles are configured to ink jet a polygonal array of ink spots having an average area-equivalent spot diameter d which satisfy the inequality conditions (IVa, IVb) with the coefficient $\lambda=1.3$ $$w/[1+n/\pi]\leqq d\leqq\lambda w/[\lambda+(n/\pi)\sin(\pi/n)],\ n=2,3,4 \quad \text{(IVa)},$$

$$w/[1+(n/\pi)\tan(\pi/n)]\leqq d\leqq\lambda w/[\lambda+(n/\pi)\sin(\pi/n)],\ n=5,6,7, \quad \text{(IVb)}.$$

In one exemplary embodiment, the n nozzles are located at vertices of a polygon having an average side length $s_{avg}$, and wherein each side length of the polygon is less than 20% deviation from the average side length $s_{avg}$ which satisfies the inequality conditions (Va, Vb) with the coefficient $\lambda=1.3$ $$d\sin(\pi/n)/\lambda\leqq s_{avg}\leqq d,\ n=2,3,4 \quad \text{(Va)},$$

$$d\sin(\pi/n)/\lambda\leqq s_{avg}\leqq d\tan(\pi/n),\ n=5,6,7, \quad \text{(Vb)}.$$

In an alternative embodiment, the n nozzles are located at vertices of a regular polygon having side length s which satisfy the inequality conditions (VIa, VIb) with the coefficient $\lambda=1.3$ $$d\sin(\pi/n)/\lambda\leqq s\leqq d,\ n=2,3,4 \quad \text{(VIa)},$$

$$d\sin(\pi/n)/\lambda\leqq s<d\tan(\pi/n),\ n=5,6,7, \quad \text{(VIb)}.$$

Another embodiment of the present invention comprises an ink jet print head adapted to minimize orientation-induced line-width variation. The print head comprises: n nozzles, wherein the n nozzles are located at vertices of a polygon having an average side length $s_{avg}$, and wherein each side length of the polygon is less than 20% deviation from the average side length $s_{avg}$. Each of the n nozzles is configured to ink jet a spot having an average area-equivalent spot diameter d which satisfies the inequality conditions (VIIa, VIIb) with the coefficient $\lambda=1.3$ $$s_{avg}\leqq d\leqq\lambda s_{avg}\csc(\pi/n),\ n=2,3,4 \quad \text{(VIIa)},$$

$$s_{avg}\cot(\pi/n)\leqq d\leqq\lambda s_{avg}\csc(\pi/n),\ n=5,6,7, \quad \text{(VIIb)}.$$

Yet another aspect of the present invention is an ink jet print head adapted to minimize orientation-induced line-width variation. The ink jet print head comprises n nozzles, wherein the n nozzles are located at vertices of a polygon for the purpose of ink jetting a polygonal array of ink spots having an average area-equivalent spot diameter d. Each of the side lengths s of the polygon satisfies the inequality conditions (VIIIa, VIIb) with the coefficient $\lambda=1.3$ $$d\sin(\pi/n)/\lambda\leqq s\leqq d,\ n=2,3,4 \quad \text{(VIIIa)},$$

$$d\sin(\pi/n)/\lambda\leqq s\leqq d\tan(\pi/n),\ n=5,6,7, \quad \text{(VIIIb)}.$$

In yet another exemplary embodiment, n ranges from 2 to 20. In an alternative embodiment, n ranges from 2 to 6. In another exemplary embodiment, d ranges from about 20 μm to about 300 μm and w ranges from about 50 μm to about 2000 μm.

Figure 2:
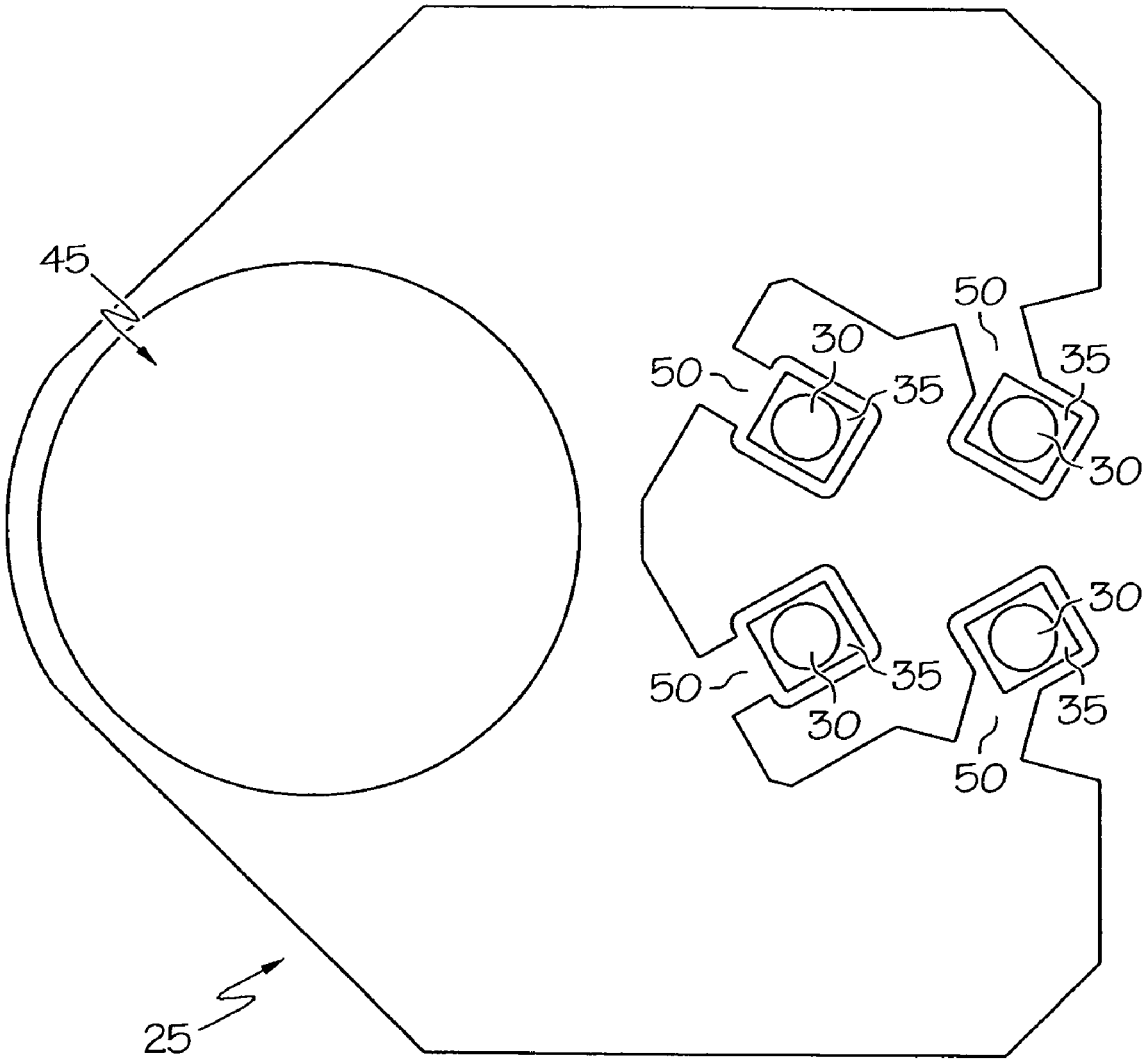
FIG. 2 illustrates a plan view of an exemplary ink jet print head according to a second embodiment of the present invention.

One exemplary embodiment of a printhead of the present invention is illustrated in FIG. 2. The printhead 25 comprises four nozzles (n=4) 30 and resistive heaters 35 configured at the vertices of a square. The printhead 25 comprises a circular ink supply via 45 and four ink supply channels 50 rendered in a polymer barrier layer.

Figure 3:
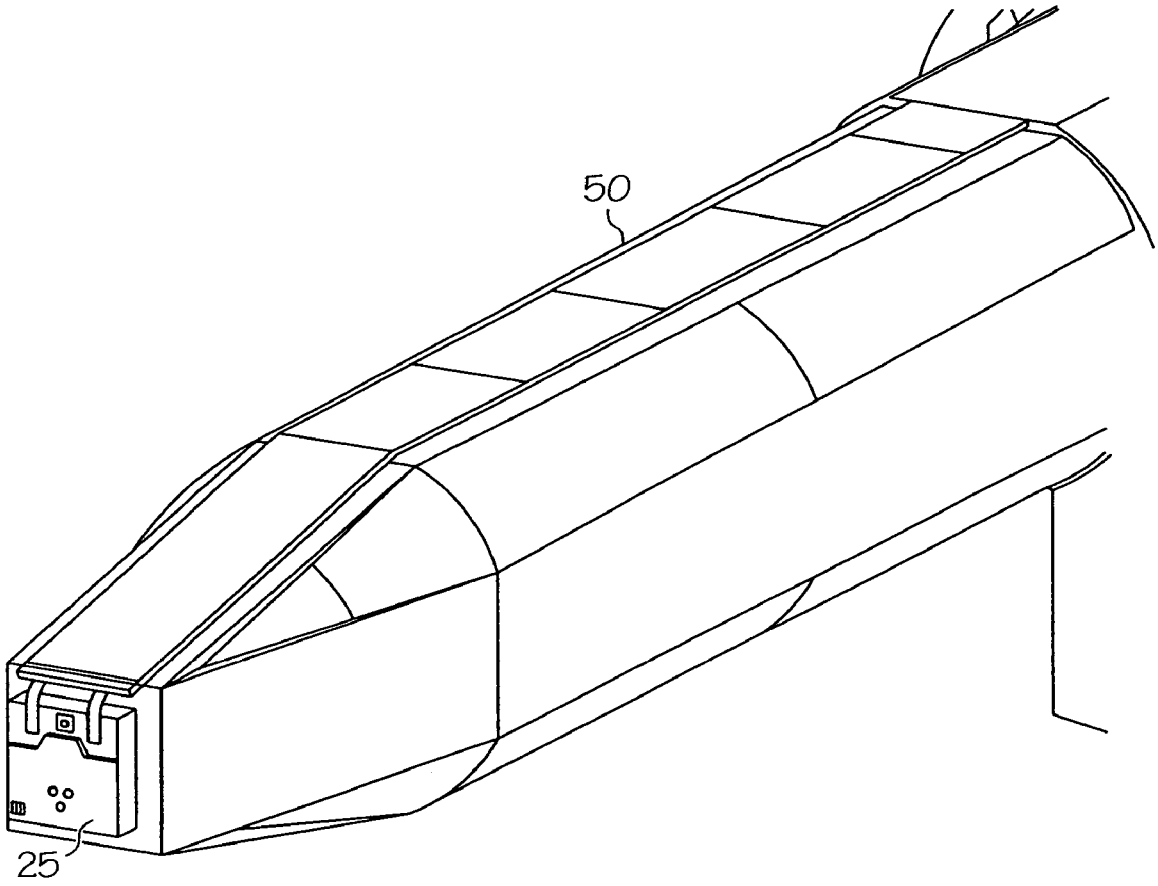
FIG. 3 illustrates an exemplary ink jet print head mounted on the tip of a ink jet pen body according to a third embodiment of the present invention.
Figure 4:
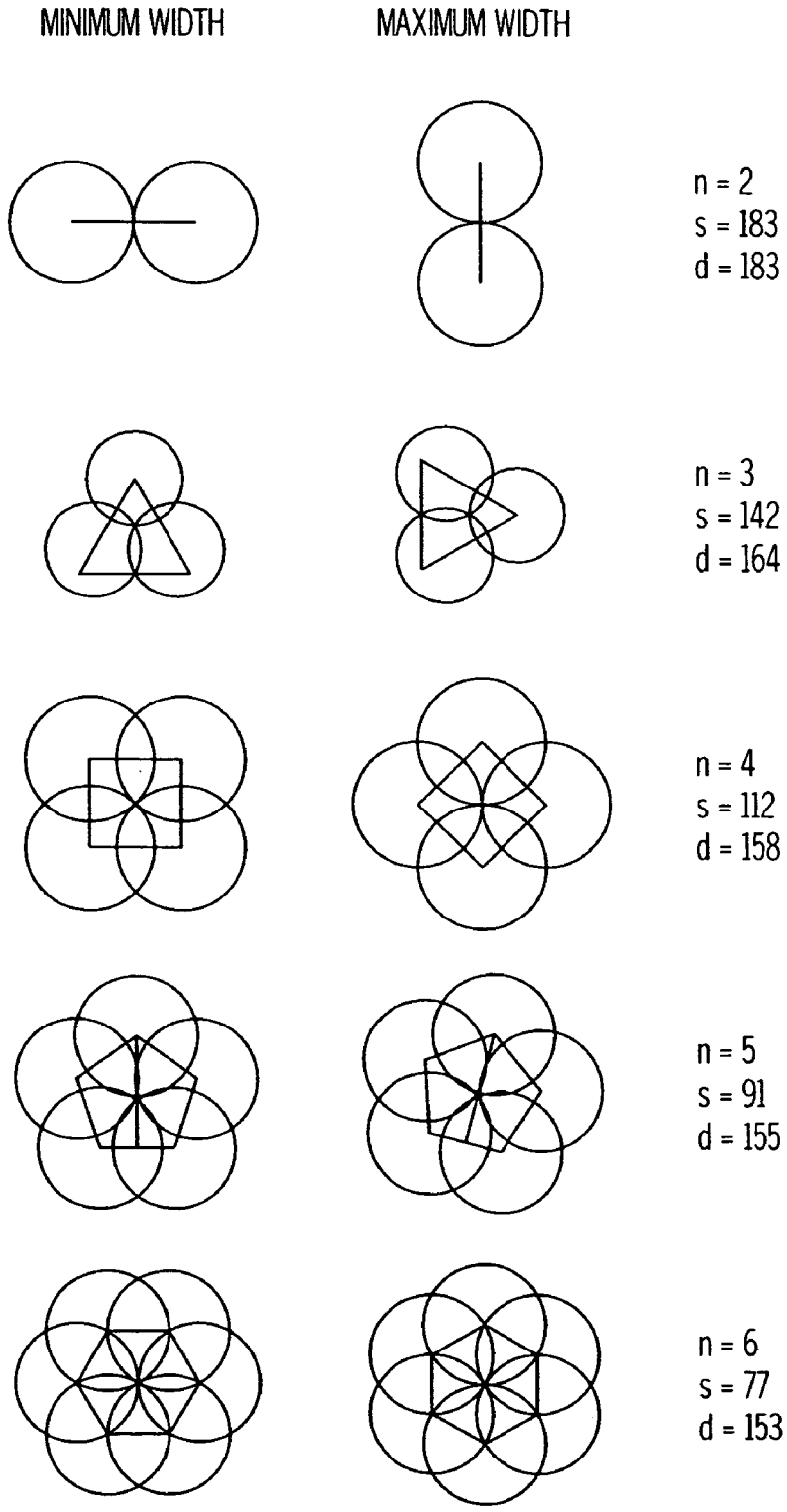
FIG. 4 is a schematic illustration of exemplary ink spot placements formed by the operation of exemplary ink jet print head configurations according to a fourth embodiment of the present invention.

An exemplary ink jet pen 50 of the present invention is illustrated in FIG. 3. The inkjet pen 50 has a printhead 25 mounted on the tip of the ink jet pen body 50.

EXAMPLES

Table 1 illustrates an exemplary embodiment of the present invention by way of numerical examples for nozzle counts n = 2, 3, . . . 9, with each column devoted to a specified value of n. The elements of the first column identify the contents of the corresponding row by the names or symbols introduced above. The numerical values occupying the body of the table are computed using the formulae introduced above. The top portion of the table contains values of w, n, Φ(n), ψ(n) and β(n) common to the three lower parts of the table.

The second portion of Table 1 contains values of d, s, 2R, 2t, h(θ) and h* and of the difference h(ψ)−h(0) corresponding to the lower bound of spot diameter d. The difference h(ψ)−h(0) represents to the difference in line-width expected due to pen body rotation.

Similarly, the third portion of Table 1 contains values of d, s, 2R, 2t, h(θ) and h* and of the difference h(ψ)−h(0) corresponding to the optimum spot diameter d =2R.

The fourth and final portion of Table 1 contains values of d, s, 2R, 2t, h(θ) and h* and of the difference h(ψ)−h(0) corresponding to the maximum spot diameter d=2λR, as specified by the maximum spot diameter oversize ratio λ, for a value λ=1.3.

TABLE 1

| Nozzle Configurations and Spot Diameters Determined by Intended Line Width . . . numerical examples for the case w = 300 um | | | | | | | | | |
|---|---|---|---|---|---|---|---|---|---|
| w | um | 300 | 300 | 300 | 300 | 300 | 300 | 300 | 300 |
| n | | 2 | 3 | 4 | 5 | 6 | 7 | 8 | 9 |
| phi(n) | radian | 1.571 | 1.047 | 0.785 | 0.628 | 0.524 | 0.449 | 0.393 | 0.349 |
| | degree | 90 | 60 | 45 | 36 | 30 | 25.7 | 22.5 | 20 |
| n mod(2) | | 0 | 1 | 0 | 1 | 0 | 1 | 0 | 1 |
| psi(n) | radian | 1.571 | 0.524 | 0.785 | 0.314 | 0.524 | 0.224 | 0.393 | 0.175 |
| | degree | 90 | 30 | 45 | 18 | 30 | 12.85714 | 22.5 | 10 |
| beta(n) | | 1 | 0.866 | 1 | 0.951 | 1 | 0.975 | 1 | 0.985 |
| Minimum Spot Diameter: d = s(n) for n = 2, 3, 4; d = 2t(n) for n = 5, 6, 7, . . . | | | | | | | | | |
| d(n) | um | 183 | 153 | 132 | 139 | 143 | 145 | 146 | 147 |
| s(n) | um | 183 | 153 | 132 | 101 | 82 | 70 | 60 | 53 |
| 2R(n) | um | 183 | 177 | 187 | 172 | 165 | 161 | 158 | 156 |
| 2t(n) | um | 0 | 89 | 132 | 139 | 143 | 145 | 146 | 147 |
| h(0) | um | 183 | 153 | 187 | 164 | 165 | 157 | 158 | 154 |
| h(psi) | um | 0 | 133 | 132 | 156 | 143 | 153 | 146 | 152 |

TABLE 1-continued

| | | | | | | | | | |
|---|---|---|---|---|---|---|---|---|---|
| h* = h(mean) | um | 117 | 147 | 168 | 161 | 157 | 155 | 154 | 153 |
| h(psi) − h(0) | um | 183 | 21 | 55 | 8 | 22 | 4 | 12 | 2 |
| Optimal Spot Diameter: d = 2R(n) for n = 2, 3, 4, 5, . . . | | | | | | | | | |
| d(n) | um | 183 | 164 | 158 | 155 | 153 | 153 | 152 | 152 |
| s(n) | um | 183 | 142 | 112 | 91 | 77 | 66 | 58 | 52 |
| 2R(n) | um | 183 | 164 | 158 | 155 | 153 | 153 | 152 | 152 |
| 2t(n) | um | 0 | 82 | 112 | 125 | 133 | 137 | 140 | 142 |
| h(0) | um | 183 | 142 | 158 | 147 | 153 | 149 | 152 | 149 |
| h(psi) | um | 0 | 123 | 112 | 140 | 133 | 145 | 140 | 147 |
| h* = h(mean) | um | 117 | 136 | 142 | 145 | 147 | 147 | 148 | 148 |
| h(psi) − h(0) | um | 183 | 19 | 46 | 7 | 21 | 4 | 12 | 2 |
| Maximum Spot Diameter: d = 2 lambda R(n) for n = 2, 3, 4, 5, . . . with lambda = 1.3 | | | | | | | | | |
| d(n) | um | 238 | 213 | 205 | 201 | 199 | 198 | 198 | 197 |
| s(n) | um | 97 | 91 | 74 | 62 | 53 | 46 | 40 | 36 |
| 2R(n) | um | 97 | 105 | 105 | 105 | 105 | 105 | 105 | 105 |
| 2t(n) | um | 0 | 52 | 74 | 85 | 91 | 95 | 97 | 99 |
| h(0) | um | 97 | 91 | 105 | 100 | 105 | 103 | 105 | 104 |
| h(psi) | um | 0 | 78 | 74 | 95 | 91 | 100 | 97 | 102 |
| h* = h(mean) | um | 62 | 87 | 95 | 99 | 101 | 102 | 102 | 103 |
| h(psi) − h(0) | um | 97 | 12 | 31 | 5 | 14 | 3 | 8 | 2 |

The foregoing description of the various embodiments and principles of the invention has been presented for the purposes of illustration and description. It is not intended to be exhaustive or to limit the invention to the precise forms disclosed. Many alternatives, modifications and variations will be apparent to those skilled in the art. For example, some principals of the invention may be used in different ink jet print head configurations. Moreover, although multiple inventive concepts have been presented, such aspects need not be utilized in combination, and various combinations of inventive aspects are possible in light of the various embodiments provided above. Accordingly, the above description is intended to embrace all possible alternatives, modifications, combinations, and variations that have been discussed or suggested herein, as well as all others that fall within the principals, spirit and broad scope of the invention as defined by the claims.

What I claim is:

1. An ink jet print head adapted to minimize orientation-induced line-width variation, the print head comprising:

n nozzles, wherein the n nozzles are located at vertices of a polygon having an average side length $s_{avg}$, and wherein each side length of the polygon is less than 20% deviation from the average side length $s_{avg}$;

wherein the n nozzles are configured to ink jet a line having a line-width w; and wherein each of the n nozzles is configured to ink jet a spot having an average area-equivalent spot diameter d which satisfies the inequality conditions (I)

$$0.7w \leqq d+(n/\pi)s_{avg} \leqq 1.3w \quad \text{(I).}$$

2. The ink jet print head of claim 1, wherein the polygon is a regular polygon.

3. The ink jet print head of claim 1, wherein n ranges from 2 to 10.

4. The ink jet print head of claim 1, wherein n ranges from 2 to 6.

5. The ink jet print head of claim 1, wherein d ranges from about 20 μm to about 300 μm.

6. The ink jet print head of claim 1, wherein w ranges from about 50 μm to about 2000 μm.

7. An ink jet print head adapted to minimize orientation-induced line-width variation, the print head comprising:

n nozzles, wherein the n nozzles are configured to ink jet a line having a line-width w; and wherein the n nozzles are located at vertices of a polygon having an average side length $s_{avg}$, and wherein each side length of the polygon is less than 20% deviation from the average side length $s_{avg}$ which satisfies the inequality conditions (IIa, IIb) with the coefficient λ=1.3

$$w \sin(\pi/n)/[\lambda+(n/\pi)\sin(\pi/n)] \leqq S_{avg} \leqq w/[1+n/\pi], \text{ where } n=2, 3, 4 \quad \text{(IIa), and}$$

$$w \sin(\pi/n)/[\lambda+(n/\pi)\sin(\pi/n)] \leqq s_{avg} \leqq w \tan(\pi/n)/[1+(n/\pi)\tan(\pi/n)], \text{ when } n=5, 6, 7, \quad \text{(IIb).}$$

8. The ink jet print head of claim 7, wherein the polygon is a regular polygon.

9. The ink jet print head of claim 7, wherein the n nozzles are configured to ink jet an array of ink spots with each ink spot having an average area-equivalent spot diameter d which satisfies the inequality conditions (IIIa, IIIb) with the coefficient λ=1.3

$$s_{avg} \leqq d \leqq \lambda s_{avg} \csc(\pi/n), \text{ where } n=2, 3, 4 \quad \text{(IIIa), and}$$

$$s_{avg} \cot(\pi/n) \leqq d \leqq \lambda s_{avg} \csc(\pi/n), \text{ where } n=5, 6, 7, \quad \text{(IIIb).}$$

10. An ink jet print head adapted to minimize orientation-induced line-width variation, the print head comprising:

n nozzles, wherein the n nozzles are configured to ink jet a line having a line-width w; and wherein the n nozzles are configured to ink jet a polygonal array of ink spots having an average area-equivalent spot diameter d which satisfy the inequality conditions (IVa, IVb) with the coefficient λ=1.3

$$w/[1+n/\pi] \leqq d \leqq \lambda w/[\lambda+(n/\pi)\sin(\pi/n)], \text{ where } n=2, 3, 4 \quad \text{(IVa), and}$$

$$w/[1+(n/\pi)\tan(\pi/n)] \leqq d \leqq \lambda w/[\lambda+(n/\pi)\sin(\pi/n)], \text{ where } n=5, 6, 7, \quad \text{(IVb).}$$

11. The ink jet print head of claim 10, wherein the n nozzles are located at vertices of a polygon having an average side length $s_{avg}$, and wherein each side length of the polygon is less than 20% deviation from the average side length $s_{avg}$ which satisfies the inequality conditions (Va, Vb) with the coefficient $\lambda=1.3$ $$d \sin(\pi/n)/\lambda \leqq s_{avg} \leqq d, \text{ where } n=2, 3, 4 \quad \text{(Va)},$$

$$\text{and } d \sin(\pi/n)/\lambda \leqq s_{avg} \leqq d \tan(\pi/n), \text{ where } n=5, 6, 7, \quad \text{(Vb)}.$$

12. The ink jet print head of claim 10, wherein the n nozzles are located at vertices of a regular polygon having side length s which satisfy the inequality conditions (VIa, VIb) with the coefficient $\lambda=1.3$ $$d \sin(\pi/n)/\lambda \leqq s \leqq d, \text{ where } n=2, 3, 4 \quad \text{(VIa), and}$$

$$d \sin(\pi/n)/\lambda \leqq s \leqq d \tan(\pi/n), \text{ where } n=5, 6, 7, \quad \text{(VIb)}.$$

13. An ink jet print head adapted to minimize orientation-induced line-width variation, the print head comprising:

n nozzles, wherein the n nozzles are located at vertices of a polygon having an average side length $s_{avg}$, and wherein each side length of the polygon is less than 20% deviation from the average side length $s_{avg}$; and wherein each of the n nozzles is configured to ink jet a spot having an average area-equivalent spot diameter d which satisfies the inequality conditions (VIIa, VIIb) with the coefficient $\lambda=1.3$ $$s_{avg} \leqq d \leqq \lambda s_{avg} \csc(\pi/n), \text{ where } n=2, 3, 4 \quad \text{(VIIa)},$$

$$\text{and } s_{avg} \cot(\pi/n) \leqq d \leqq \lambda s_{avg} \csc(\pi/n), \text{ where } n=5, 6, 7, \quad \text{(VIIb)}.$$

14. The ink jet print head of claim 13, wherein the polygon is a regular polygon.

15. An ink jet print head adapted to minimize orientation-induced line-width variation, the print head comprising:

n nozzles, wherein the n nozzles are located at vertices of a polygon and are configured for ink jetting a polygonal array of ink spots having an average area-equivalent spot diameter d; and wherein each of the side lengths s of the polygon satisfies the inequality conditions (VIIIa, VIIIb) with the coefficient $\lambda=1.3$ $$d \sin(\pi/n)/\lambda \leqq s \leqq d, \text{ where } n=2, 3, 4 \quad \text{(VIIIa), and}$$

$$d \sin(\pi/n)/\lambda \leqq s \leqq d \tan(\pi/n), \text{ where } n=5, 6, 7, \quad \text{(VIIIb)}.$$

16. The ink jet print head of claim 15, wherein the polygon is a regular polygon.

* * * * *